United States Patent [19]

Watai et al.

[11] Patent Number: 4,790,861

[45] Date of Patent: Dec. 13, 1988

[54] ASHTRAY

[75] Inventors: Minoru Watai; Yasukazu Nishimuro; Koichi Iwabuchi, all of Kanagawa, Japan

[73] Assignee: NEC Automation, Ltd., Kanagawa, Japan

[21] Appl. No.: 60,636

[22] Filed: Jun. 11, 1987

[30] Foreign Application Priority Data

Jun. 20, 1986 [JP] Japan ..... 61-142960
Mar. 4, 1987 [JP] Japan ..... 62-47819

[51] Int. Cl.[4] ..... B03C 3/40

[52] U.S. Cl. ..... 55/137; 55/152; 55/154; 55/385.6; 131/235.1

[58] Field of Search ..... 55/385 G, 137, 150, 55/152, 154, 101; 131/231, 235.1

[56] References Cited

U.S. PATENT DOCUMENTS

| | | | |
|---|---|---|---|
| 3,656,440 | 4/1972 | Grey | 55/138 X |
| 3,668,836 | 6/1972 | Richardson et al. | 55/154 X |
| 4,177,045 | 12/1979 | Orel | 55/385 G X |
| 4,496,375 | 1/1985 | Le Vantine | 55/137 X |

*Primary Examiner*—Kathleen J. Prunner
*Attorney, Agent, or Firm*—James E. Nilles; Thomas F. Kirby

[57] ABSTRACT

An ashtray having a small electrode and a large electrode. A high voltage is applied between the two electrodes so that ions are produced to ionize smoke particles, air is caused to flow from the small electrode to the large electrode and the ionized smoke particles adhere to the large electrode. An auxiliary electrode is provided to connect electrically to the large electrode.

3 Claims, 2 Drawing Sheets

ASHTRAY

BACKGROUND OF THE INVENTION

1. Field of the Invention

The present invention relates to an ashtray, particularly to an ashtray which catches smoke by attraction.

2. Description of the Prior Art

In conventional ashtrays, a filter and a fan are provided. However, in many of the conventional ashtrays, most of the particles of the smoke of tobacco are not caught but scatter around because the diameter of each of the particles is as small as 0.3 μm or less.

SUMMARY OF THE INVENTION

The present invention was made in order to provide an ashtray which efficiently catches the smoke of tobacco but thereon, to keep the smoke from scattering around.

Accordingly, it is an object of the present invention to provide an ashtray comprising a small electrode; a large electrode; and a means for applying a high voltage between both the electrodes.

It is another object of the present invention to provide an ashtray comprising an ash reception plate; a small electrode provided over the ash reception plate at a distance therefrom; an auxiliary electrode opposed to the small electrode; a large electrode electrically coupled to the auxiliary electrode; and a means for applying a high voltage between the small electrode and the auxiliary electrode and between the small electrode and the large electrode.

A further object and characteristics of the present invention will now be explained with reference to the attached drawings.

DETAILED DESCRIPTION OF THE PREFERRED EMBODIMENT

Figure 3:
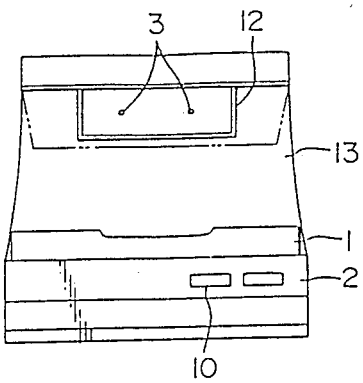
FIG. 3 shows a front view of the ashtray shown in FIG. 2.
Figure 4:
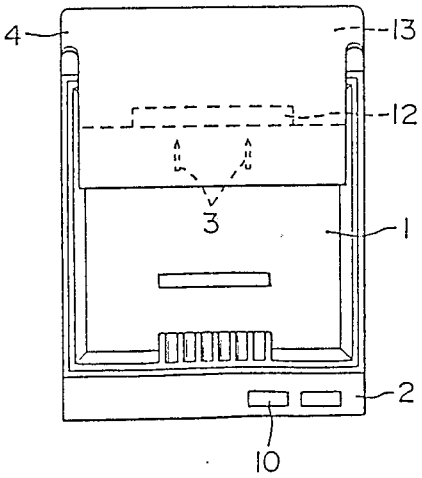
FIG. 4 shows a plan view of the ashtray shown in FIG. 2.
Figure 2:
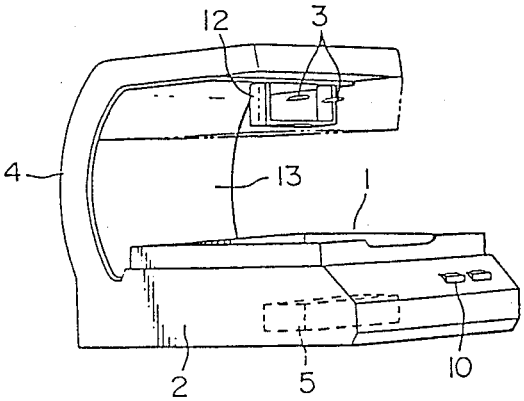
FIG. 2 shows a perspective view of an ashtray which is an embodiment of the present invention.

FIGS. 2, 3 and 4 show an ashtray which is a preferred embodiment of the present invention and has an ash reception plate 1 and a base 2 therefor. The ash reception plate 1 is made of an electroconductive material such as a metal plate. Needle-like electrodes 3 constituting small electrodes are provided over the ash reception plate 1 at a distance therefrom and held by an arm 4 on the base 2. In the ashtray, a frame-like electrode 12 constituting an auxiliary electrode, whose cross section is oblong or circular, is provided beside needle-like electrodes 3 at a distance therefrom. A plate electrode 13, constituting a large electrode bent in a U-shape or arc, is integrally coupled to the frame-like electrode 12 so that the flat or curved surface of the plate electrode 13 faces the side surface of the ash reception plate 1. A high voltage from a high-voltage power supply 5 provided in the base 2 is applied between the electrodes 12 and 13 and the needle-like electrodes 3 through an insulated electric wire not shown in the drawings.

Figure 1:
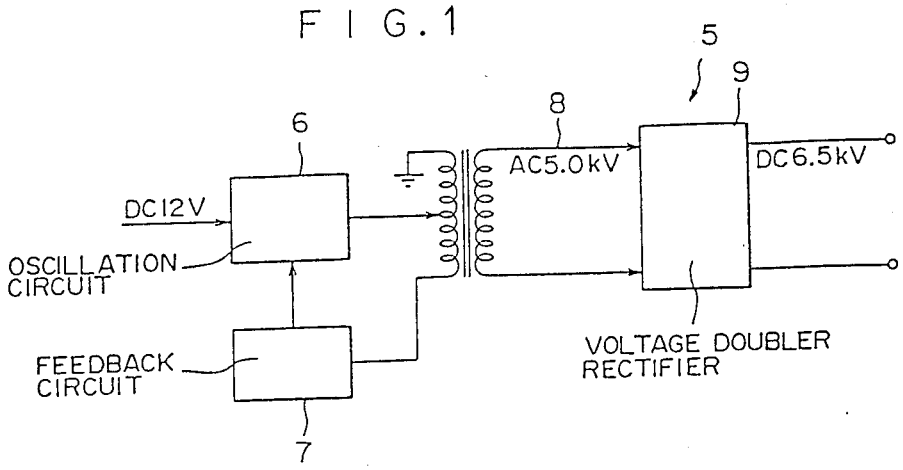
FIG. 1 shows a circuit diagram of a high-voltage power supply.

FIG. 1 shows the high-voltage power supply 5 in which a DC voltage of 12V is converted into a high-frequency signal by an oscillation circuit 6; the high-frequency signal is applied to the primary coil of a boosting transformer 8 through a feedback circuit 7; and an AC voltage of 5.0 kV from the secondary coil of the transformer 8 is rectified by a voltage doubler rectifier 9 to produce a DC output voltage of 6.5 kV, for example. A commercial AC voltage may be used instead of the DC voltage of 12V. The AC voltage from the secondary coil of the boosting transformer 8 may be directly applied between the electrodes 12, 13 and 3 instead of the DC output voltage of 6.5 kV.

Shown at 10 in FIGS. 2, 3 and 4 is a push-button power switch provided in a circuit through which the DC voltage of 12V is applied to the oscillation circuit 6. When the transparent push button of the switch 10 is pressed, a lamp inside the push button is lit so that it is possible to confirm by eyesight whether the switch 10 is turned on or off.

When the high voltage is applied between both the electrodes 3 and 12 and between the electrodes 3 and 13 by pressing the switch 10 in the embodiment, a flow of ions from the needle-like electrodes 3 toward the central portion of the frame-like electrode 12 is caused and the flow further proceeds along the plate electrode 13. Corona discharges are formed between the large electrode and the small electrode, so that ion particles are produced and impinge against particles of smoke of tobacco put on the ash reception plate 1 to ionize them. The ionized particles of the smoke are moved toward the large electrode in the electric field formed between the two electrodes and adhere. The smoke of tobacco put on an ash reception plate 1 is caused to flow from the ash reception plate 1 toward the plate electrode 13 along with the flow of the ions so that the ionized particles of the smoke are caught on the surface of the plate electrode 13 by an electrostatic force. The smoke of the tobacco is thus prevented from scattering around the ash reception plate 1. Therefore, the purpose is surely attained.

In the above-described embodiment, the needle-like electrodes 3 may be made up of either a single electrode or a plurality of electrodes spaced apart one another. The electrodes 3 may also be shaped as a ball, a rod, a spicule or saw teeth. The framelike electrode 12 may be reticulate. The plate electrode 13 may have projections and recesses or be reticulate.

The above-described ashtray provided in accordance with the present invention has a large advantage that the smoke of tobacco is efficiently attracted and caught without using a fan and expendables such as a filter.

What is claimed is:

1. An ashtray comprising an ash reception plate; a small electrode provided over said ash reception plate at a distance therefrom; an auxiliary electrode opposed to said small electrode; a large electrode electrically coupled to said auxiliary electrode, disposed below said small electrode, alongside said auxiliary electrode and above said ash reception plate; and a means for applying a high voltage between said small electrode and said auxiliary electrode and between said small electrode and said large electrode.

2. An ashtray according to claim 1, in which the large electrode is a plate having a curved surface located beside the ash reception plate.

3. An ashtray according to claim 1, in which the auxiliary electrode is a frame-like electrode.

* * * * *